United States Patent [19]

Kato

[11] Patent Number: 4,869,411

[45] Date of Patent: Sep. 26, 1989

[54] ROLL FEED APPARATUS

[75] Inventor: Heizaburou Kato, Shizuoka, Japan

[73] Assignee: Sankyo Manufacturing Company, Ltd., Tokyo, Japan

[21] Appl. No.: 290,956

[22] Filed: Dec. 28, 1988

[51] Int. Cl.[4] ..... B65H 20/18; B65H 20/22

[52] U.S. Cl. ..... 226/142; 226/149; 226/152; 226/154

[58] Field of Search ..... 226/152, 156, 139, 141, 226/142, 147, 149; 364/561, 562, 563, 164, 579, 469, 471, 478, 479, 167

[56] References Cited

U.S. PATENT DOCUMENTS

| | | | |
|---|---|---|---|
| 3,473,716 | 10/1969 | Butler | 226/142 |
| 3,494,526 | 2/1970 | Calvert et al. | 226/142 X |
| 4,068,297 | 1/1978 | Komiya | 364/167 X |
| 4,430,698 | 2/1984 | Harris | 364/164 X |
| 4,545,518 | 10/1985 | Bergland | 226/139 |
| 4,549,683 | 10/1985 | Kato | 226/142 |
| 4,550,278 | 10/1985 | Yamanaka | 364/164 X |
| 4,635,216 | 1/1987 | Stutz et al. | 364/562 |
| 4,638,990 | 1/1987 | Kato | 226/142 X |
| 4,638,991 | 1/1987 | Kato | 226/142 X |
| 4,658,648 | 4/1987 | Roddeck et al. | 364/563 X |
| 4,715,008 | 12/1987 | Jones | 364/563 |
| 4,776,505 | 10/1988 | Kato | 226/149 X |

FOREIGN PATENT DOCUMENTS

| | | | |
|---|---|---|---|
| 130831 | 9/1984 | Japan . | |
| 130832 | 9/1984 | Japan . | |
| 0178302 | 9/1985 | Japan | 364/562 |

*Primary Examiner*—David Werner
*Assistant Examiner*—Phillip Han
*Attorney, Agent, or Firm*—Pollock, Vande Sande & Priddy

[57] ABSTRACT

A roll feed apparatus in which a plate material is held in a pair of rolls and fed intermittently, in a predetermined length at a time, by the oscillated operation of the rolls, the distance between the rolls is adjusted by a material thickness adjusting mechanism, the power of the rolls for holding the material is adjusted by a holding power adjusting mechanism, and the length of each feed of the material is adjusted by a feed length adjusting mechanism. The material thickness adjusting mechanism, the holding power adjusting mechanism and the feed length adjusting mechanism are automatically numerically controlled by an electrical control system without direct manual operation.

5 Claims, 2 Drawing Sheets

ROLL FEED APPARATUS

CROSS-REFERENCE TO RELATE APPLICATION

The present application relates to subject matter described in U.S. Pat. No. 4,776,505 entitled "ROLL FEED APPARATUS" by Heizaburo Kato, and assigned to the assignee of the present application, and in U.S. Pat. No. 4,586,259 entitled "OUTPUT ROTATIONAL ANGLE INDICATING DEVICE OF ROCKING ROTATIONAL ANGLE ALTERING SYSTEM" by Heizaburo Kato, and assigned to the assignee of the present application.

BACKGROUND OF THE INVENTION

1. FIELD OF THE INVENTION

The present invention relates to a roll feed apparatus for feeding a plate material held between a pair of rolls intermittently by a predetermined length each time into a production machine such as a press, or more in particular to a roll feed apparatus comprising component parts with mechanisms numerically controlled according to an electrical control circuit for feeding a plate material directly without manual operation.

2. DESCRIPTION OF THE RELATED ART

The same applicant suggested earlier a roll feed apparatus for feeding a plate material held in a pair of rolls intermittently by a predetermined length each time into a production machine such as a press, in which the plate material can be accurately set in position (Japanese utility model application No. 59639/87, U.S. Ser. No. 130,848). This roll feed apparatus comprises a material thickness adjusting mechanism for adjusting the distance between upper and lower rolls in accordance with the thickness of the plate material, a holding power adjusting mechanism for adjusting the power of the upper and lower rolls holding and feeding the material, and a feed length adjusting mechanism for adjusting the length of the material fed.

In the above-described conventional roll feed apparatus, the material thickness, the holding power and feed length are directly adjusted manually by the operator visually watching the indication on a plurality of counters included in and operatively interlocked with the adjusting mechanisms respectively. An apparatus has also been suggested conventionally in which a small motor supports this manual operation to facilitate the adjusting work. Generally, however, the burden on the operator has been considerably heavy, and the fact that the adjusting work generally depends on the ability of each operator has caused undesirable variations in adjustment.

SUMMARY OF THE INVENTION

The object of the present invention is to provide a roll feed apparatus in which each of the material thickness adjusting mechanism, the material holding power adjusting mechanism and the material feed length adjusting mechanism is operated by a numerical control means thereby to save the burden of the operator and eliminate adjustment variations.

According to the present invention, there is provided a roll feed apparatus comprising a pair of rolls for holding a plate material therebetween and oscillated to feed a plate material intermittently a predetermined length each time, a material thickness adjusting mechanism for adjusting the distance between the two rolls, a holding power adjusting mechanism for adjusting the power for holding the material in the rolls, a feed length adjusting mechanism for adjusting the length of material fed each time, input unit for entering numerical data providing targets of adjustment of the material thickness, holding power and material feed length respectively, a processing unit for storing the various numerical data thus entered, the operating conditions of an object of control and data on a control program and producing a control command based on these data, a plurality of drive units for driving the adjusting mechanisms and including signal generators for producing data on he operating conditions respectively, and a comparator supplied with a control command from the processing unit together with the data from the signal generator of a drive unit associated with the control command for comparing the control command and the data thus inputted with each other thereby to operate the drive unit in stable manner.

In the roll feed apparatus according to the present invention, the operator inputs appropriate numerical data on the material thickness, holding power and material feed length by way of the input unit like a keyboard in order to perform a control operation, whereupon the drive units like servo motors for operating a material thickness adjusting mechanism, a holding power adjusting mechanism and a feed length adjusting mechanism are automatically controlled appropriately by a processing unit and a comparator in such a manner that the distance between the rolls may coincide with the input value, thereby numerically controlling and adjusting the inter-roll distance, roll holding power and the material feed length directly to respective target values accurately and stably without human labor.

According to another aspect of the present invention, there is provided a roll feed apparatus comprising a numerical control unit for controlling the operation of drive motors, whereby the roll gap and other factors are automatically adjusted simply by the operator applying appropriate numerical data by way of an input unit, thereby saving manual adjusting work off the operator and eliminating variations of adjustments which otherwise might be dependent on the ability of each operator.

DESCRIPTION OF THE PREFERRED EMBODIMENTS

An embodiment of the present invention will be explained below with reference to the accompanying drawings.

Figure 1:
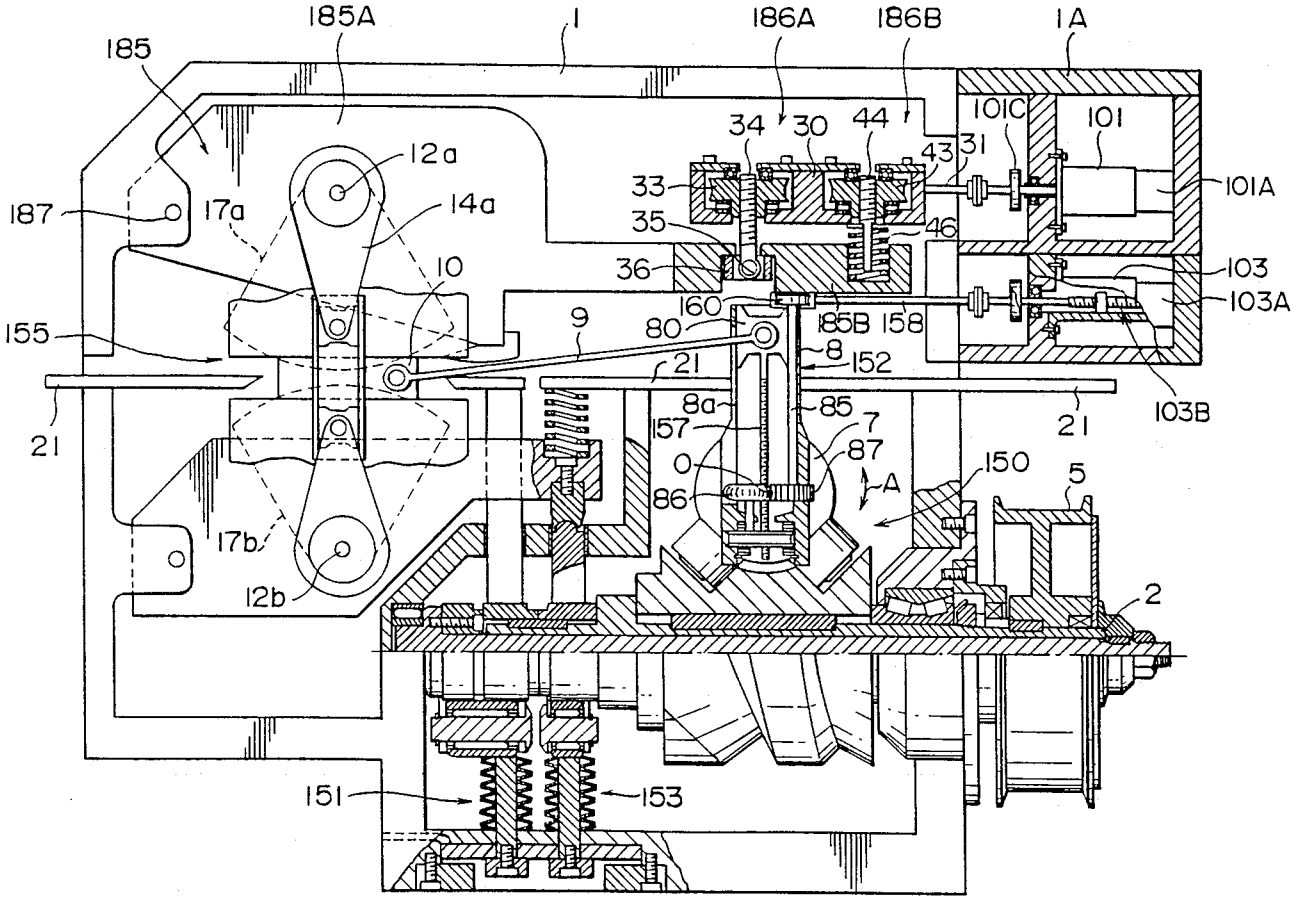
FIG. 1 is a partially cut-away sectional view for explaining a general configuration of a roll feed apparatus according to the present invention.
Figure 2:
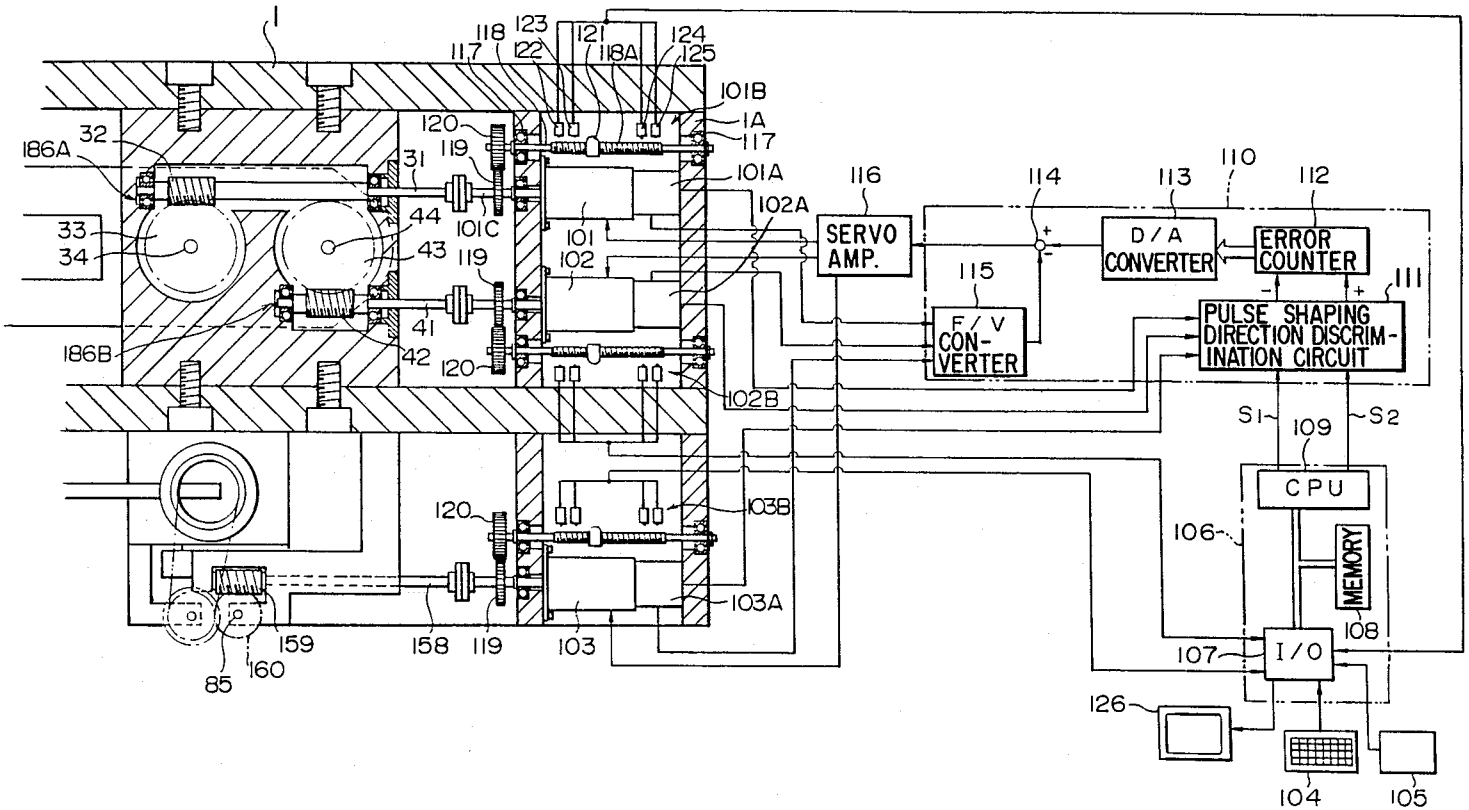
FIG. 2 is a diagram showing a configuration of a control unit and parts related thereto.

FIG. 1 shows a general configuration of a roll feed apparatus comprising a numerical control applicable according to the present invention, and FIG. 2 a configuration of a control unit including electrical means and a worm gear wheel mechanism.

First, a general configuration of the roll feed apparatus will be explained with reference to FIG. 1. The roll feed apparatus comprises a drive shaft 2 rotationally driven through a pulley 5, an oscillation rotary drive unit 150, an upper first roll 17*a* mounted integrally on a first roll shaft 12*a*, a lower second roll 17*b* mounted integrally on a second roll shaft 12*b* extending parallelly with the first roll shaft 12*a*and constructed to hold and transport a plate material in cooperation with the first roll 17*a*, an interlocking mechanism 155 for operatively interlocking the two rolls, a turning-effort transmission means 152 for transmitting the oscillation turning effort of the oscillation rotary drive unit 150 to the interlocking mechanism 155, a roll release means 153, and a plate material brake means 151. The first roll 17*a* and the second roll 17*b*, as shown by dashed lines in FIG. 1, have a sectional view in sectorial form. In this roll feed apparatus, a plate material is held in the rolls 17*a*, 17*b* and fed from right to left in the drawing along the upper surface of a guide member 21 into a press or the like machine. The roll feed apparatus comprises a material thickness adjusting mechanism for adjusting the distance between the upper and lower rolls 17*a*, 17*b* in accordance with the thickness of the material, a holding power adjusting mechanism for adjusting the power of the rolls 17*a*, 17*b* holding the material fed, and a feed length adjusting mechanism for adjusting the length of the material fed each time. These mechanisms enable a plate material to be held in a pair of rolls 17*a*, 17*b* and fed intermittently into a press or the like machine by a predetermined length each time.

The material thickness adjusting mechanism includes a drive member 185 with an intermediate part thereof mounted on the roll shaft 12*a*and a worm gear wheel mechanism 186A.

The drive member 185 has a drive plate 185A with an end thereof fitted on an end of the drive shaft 187 and a longitudinal intermediate point thereof fitted on an end of the first roll shaft 12*a*. The drive plate 185A is positioned at an upper part on this side of the page with respect to the first roll 17*a* and at the same time at the upper part on the other side of the page with respect to the first oscillation arm 14*a* and the slide block 10. The drive member 185 also has a second drive plate (not shown) of the same shape as and extending in parallel to the drive plate 185A. This second drive plate has an end thereof fitted on the other end of the drive shaft 187 and a longitudinal intermediate point thereof fitted on the other end of the first roll shaft 12*a*, and is positioned at the upper part on the other side of the page with respect to the first roll 17*a* in FIG. 1. The free ends of these drive plates are configured to be connected by a plate material 185B extending in the direction perpendicular to the page in FIG. 1.

The worm gear wheel mechanism 186A includes a second wheel 33 screwed to a second threaded bar 34 and a second worm gear 32 mounted at an end of the second worm shaft 31 and engaged with the second wheel 33. The second worm gear 32 and the second wheel 33 are housed in a case 30 secured to a housing 1 of the roll feed apparatus. Also, the second threaded bar 34 carries at the lower end thereof a bearing block 36 through a pin 35, which bearing block 36 is in contact with the top of a downwardly open recess formed in a plate material 185B. The second worm shaft 31 is driven by the turning effort of the servo motor 101 transmitted thereto through a joint, a shaft and a timing belt.

In the above-mentioned configuration, when the second worm shaft 31 is driven and rotated in the clockwise or counterclockwise direction by the operation of the servo motor 101, the second threaded bar 34 is moved upward or downward in accordance with the direction of rotation thereof through the second worm gear 32 and the second wheel 33, so that the free end of the drive member 185 is moved upward or downward through the bearing block 36. As a result, the drive member 185 is driven in the counterclockwise or clockwise direction around the drive shaft 187, and thereby moves the first roll shaft 12*a* and the first roll 17*a* integreted therewith upward or downward, thus changing the magnitude of the gap between the two rolls 17*a* and 17*b*. In this manner, the size of the gap between the two rolls can be adjusted to a proper value corresponding to the thickness of the plate material to be fed by rotating the second worm shaft 31 clockwise or counterclockwise by an appropriate amount.

The holding power adjusting mechanism includes the drive member 185 and the worm gear wheel mechanism 186B.

The worm gear wheel mechanism 186B includes a first wheel 43 screwed to the first threaded bar 44 and a first worm gear 42 engaing the first wheel 43 mounted at an end of the first worm shaft 41. Also, the first worm gear 42 and the first wheel 43 are housed in the case 30 secured o the housing 1 of the roll feed apparatus. The lower end of the first threaded bar 44 is in contact, through a spring 46, with the bottom of an upwardly open recess formed in the plate material 185B of the drive member 185. The first worm shaft 41 is driven by the turning effort of the servo motor 102 transmitted through a joint, a shaft and a timing belt.

In this configuration, when the first worm shaft 41 is driven and rotated in the clockwise or counterclockwise direction by the operation of the servo motor 102, the first threaded bar 44 is moved upward or downward through the first worm gear 42 and the first wheel 43, thereby changing the force of the spring 46 pressing the free end of the drive member 185 downward. In other words, the force of the speing 46 energizing the drive member 185 clockwise around the drive shaft 187 is changed, thereby changing the force for pressing the first roll shaft 12*a*and the first roll 17*a* integrated therewith toward the second roll 17*b*. As a result, it is possible to adjust the holding power applied to the material between the two rolls 17*a* and 17*b* to an appropriate value by rotating the first worm shaft 41 by an appropriate amount in the clockwise or counterclockwise direction.

Now, the feed length adjusting mechanism will be briefly explained.

In FIG. 1, the turning effort transmission means 152 includes an oscillation member 8 fitted integrally on the central shaft of a turret 7 and adapted to be oscillated in the manner designated by A integrally with the turret 7 around a point 0 and a connecting rod 9 for coupling a sliding block 80 in the oscillation member 8 to a slider 10 of the interlocking mechanism 155. The oscillation member 8 is so constructed that the sliding block 80 is slided longitudinally of the oscillation member 8 thereby to change the amount of lateral side of the slide block against the oscillation angle of the oscillation member 8, thus changing the rotational angle of the rolls 17*a*, 17*b* against the oscillation angle of the oscillation member 8. The configuration and functions of this oscillation member, which are described in detail in Japanese utility model application Nos. 59639/87 and 36858/84, will be briefly explained. Upon rotation of a rod 158, a rotary shaft 85 and a spur gear 87 integral therewith are rotated through a worm gear 159 and a wheel 160. A threaded bar 157 and a sliding block 80 are set in motion in the direction longitudinal of the arm 8*a* within the arm 8*a* through an arcuate gear 86, the rotary shaft thereof, a pulley and a belt. This motion of the sliding block 80 changes the rotational angle of the rolls 17*a*, 17*b* against the oscillation angle of the oscillation member 8 as described above. As a result, by moving the sliding block 80, it is possible to change the rotational angle of the rolls and thereby to change the amount of each feed of the plate material intermittently fed by the roll feed apparatus. According to this embodiment, the rotation of the rod 158 is effected by the servo motor 103.

Now, a configuration of the control means will be explained. The objects to be controlled by the control means include the servo motor 101 for imparting the rotative driving force to the worm shaft of the material thickness adjusting mechanism, the servo motor 102 for applying the rotative driving force to the worm shaft 41 of the holding power adjusting mechanism, and the servo motor 103 for applying the rotative driving force to the rod 158 of the feed length adjusting mechanism.

Numeral 104 designates an input unit for entering data indicating the material thickness, holding power and feed length separately by way of a keyboard operated by the operator. Numeral 105 designates a tape input unit providing an alternative means of entry of data or other control programs by way of tape. Data from these input units are applied to the processing circuit 106. The processing circuit 106 determines control data on the direction and angle of rotation necessary for instructing each servo motor on the basis of the conditions of the servo motors and input data related to each servo motor and a reference point data. The processing circuit 106 includes an I/O unit 107 making up an input/output section, a memory 108 for storing input data and data on the conditions of the servo motors, and a CPU 109 for processing the data and producing a required control command signal. These component parts are connected to each other by buses.

Numeral 110 designates a comparator circuit including a pulse shaping direction discrimination circuit 111, an error counter 112, a D/A converter 113, an adder 114 and an F/V converter 115. A command pulse $S_1$ relating to the rotational angle and a command code $S_2$ related to the rotational direction produced from the CPU 109 of the processing circuit 106 are applied to the pulse shaping direction discrimination circuit 111. The pulse shaping direction discrimination circuit 111 is also supplied with a position signal representing the rotational position of the output shafts of the servo motors 101, 102 and 103 as fed back in pulse signal form. The pulse shaping direction discrimination circuit 111 sets the number of command pulses applied thereto in the error counter 112 while indicating the direction of rotation given by the polarity of the command code. The value set in the error counter 112 is converted into a voltage value by the D/A converter, and after being amplified as a speed command signal in a servo amplifier 116, is applied to the corresponding servo motors 101, 102 and 103. Each of these servo motors is driven to a designated rotational angle at a rotational speed designated by the speed command signal associated therewith.

The servo motors 101, 102, 103 are securely mounted in the motor case 1A attached to the housing 1, and include encoders 101A, 102A, 103A and operating condition command mechanisms 101B, 102B, 103B respectively. Each of the encoders produces a position signal representing the rotational position of a output shaft of a corresponding servo motor with the rotation thereof and a speed signal representing the rotational speed of the output shaft by the frequency thereof. Both the position signal and the speed signal are a pulse signal. The position signals from the servo motors 101, 102, 103 are fed back and applied to the pulse shaping direction discrimination circuit 111, while the speed signals are applied to the F/V converter 115, and after being converted into a voltage signal corresponding to the frequency thereof, is applied as a negative value to the adder 114.

The operating condition command mechanisms 101B, 102B and 103B are similarly configured of a threaded bar 118 having a screw 118A rotatably supported on bearings 117, 117 and a gear 120 in mesh with a gear 119 fixed on the output shaft of the servo motor, a contactor 121 screwed to the thread 118A and adapted to move with the rotation of the thread bar 118 in the corresponding direction, and four limit switches 122 to 125 turned on only when brought into contact with the contactor 121. Output signals of the four limit switches 122, 123, 124, 125 of the operating condition command mechanism of the servo motors 101, 102, 103 are applied the I/O unit 107 of the processing circuit 106. Of the limit switches 122 to 125, the limit switch 123 is a reference value command switch, the limit switch 124 a maximum value command switch, and the limit switches 122 and 125 on the ends are mechanical limit stop command switches. The maximum value command switch is one for producing a maximum value command indicating the limit of the adjusting ability to call the attention of the operator, and the mechanical limit stop command switch is for producing a command indicating the limit of the mechanical ability of motion in order to prevent the damage to the machine by stopping the apparatus rapidly, thereby calling the attention of the operator.

The servo motors 101, 102 and 103 are numerically controlled in similar manner. The numeral control of the servo motor 101 of the material thickness adjusting mechanism will be explained as an example. Assume that the operator enters a numerical value of the material thickness as data to be adjusted using the keyboard 04. This input data is stored in the memory 108 through the I/O unit 107. The memory 108 has stored therein reference point data from the limit switches 122 to 125 of the operating condition command mechanism 101B and other control program. The input data stored in the memory 108 is read by the CPU 109, which determines control data on the basis of the input data and the like and applies a command pulse $S_1$ associated with the numerical value of the control data thus obtained to the error counter 112, while at the same time producing a command code $S_2$ indicating the direction of rotation of the servo motor 101 to attain the material thickness by adjustment. In this way, the direction and amount of rotation required of the servo motor 101 is set as a digital value in the error counter 112. The digital value set in the error counter 112 is converted into an analog signal by the D/A converter 113, and after being amplified at the servo amplifier 116 as a speed signal, is supplied to the servo motor 101. The servo motor 101, in response to the speed signal, drives the output shaft 101C thereof in the designated direction. The turning effort of the output shaft 101C is transmitted to the worm shaft 31, and acts to adjust the distance between the two rolls 17*a* and 17*b* to the appropriate value designated by the keyboard in accordance with the thickness of the plate material to be fed. With the rotation of the servo motor 101, on the other hand, the rotation of the output shaft of the servo motor 101 is taken out as a position signal and a speed signal through the encoder 101A. The position signal represents the angle covered by the output shaft of the servo motor 101 from the initial position thereof in terms of the number of pulses. This position signal, after being applied to the pulse shaping direction discrimination circuit 111, is sent to the error counter 112, so that the digital value set in the error counter 112 is decremented by one for each pulse of the position signal. When the value set in the error counter 112 becomes zero, it indicates that the servo motor 101 has rotated by the angle represented by the command pulses supplied from the CPU 109, with the result that the output voltage of the comparator circuit 110 becomes zero thereby to stop the servo motor 101. In this way, the distance between the rolls 17*a* and 17*b* is adjusted in such a manner as to coincide with the numerical data of the thickness of the plate material entered by the operator by way of the keyboard 104, after which the rotation of the servo motor 101 is stopped, thereby effecting the positional control free of variations of the distance between the rolls 17*a* and 17*b*. The speed signal from the encoder 101A, on the other hand, is converted into a voltage proportional to the rotational speed of the output shaft 101C by the F/V converter 115, and applies as a negative value to the adder 114. This speed signal is thus subtracted from the speed signal produced from the D/A converter 113. As a result, the rotational speed of the output shaft of the servo motor 101 approaches a speed designated by the speed signal produced from the D/A converter 113, when the speed signal from the D/A converter 113 coincides with that from the encoder 101A, the servo motor 101 rotates at a fixed speed, thus attaining a stable rotation, that is, a stable feeding operation. Further, with the rotation of the servo motor 101, the turning effort of the output shaft thereof is transmitted through the gears 119, 120 to the threaded bar 118, which is thus rotated at the same time. With the rotation of the threaded bar 118, the contactor 121 in screwed relationship therewith is moved along the axial direction of the threaded bar 118 corresponding to the rotational direction of the output shaft on the threaded bar 118. The point where the limit switch 123 is positioned represents a reference point indicating the reference width between the rolls 17*a* and 17*b*. Adjustment is allowed from this reference point up to the position of the limit switch 124 as a maximum width. The width between the rolls 17*a* and 17*b* smaller than the width determined by the limit switch 122 or more than the width set by the limit switch 125 is prohibited. Upon rotation of the servo motor 101, therefore, the contactor 121 is moved in accordance with the width between the rolls 17*a* and 17*b* adjusted. When the motion of the contactor 121 turns on any of the limit switches 122, 123, 124 and 125, the resulting signal is applied to the processing circuit 108 and through the I/O unit 107 is stored in the memory 108. The CPU 109 decides whether the numerical control is to be continued or not by the data supplied from the limit switches 122 to 125. When the limit switch 125 is turned on, for example, the numerical control to increase the inter-roll width beyond the value set by the limit switch 125 is prohibited. In this way, it is possible to confirm the adjustment condition of the material thickness adjusting mechanism driven by the servo motor 101 on the basis of the data supplied from turned-on state of the limit switches 122 to 125. The processing circuit 106 includes display means 126 such as a CRT for indicating various data necessary for numerical control including numerical data entered by the operator and specific numeral values representing the operating conditions of the serv motor 101 and the width between the rolls 17*a* and 17*b*. The operator performs the numerical control with reference to the data supplied from the display means 126.

Although the foregoing description relates to the numerical control of the material thickness adjusting mechanism, the servo motors 102 and 103 of the holding power adjusting mechanism and the material feed length adjusting mechanism are also controllable in similar manner by use of the processing circuit 106, the comparator 110, etc. These three adjusting mechanisms, which share a common control circuit, are not controlled at the same time but separately in a predetermined order. The circuit configuration may of course be modified to permit simultaneous control. The servo motors may be replaced by control drive means such as pulse motors with equal effect.

In the material feed length adjusting mechanism, as described in detail in Japanese utility model application No. 36858/84, the relationship between the oscillation rotational angle $\alpha$ of the input shaft, the oscillation rotational angle $\beta$ of the output shaft and the link length R is expressed by a function $\beta=f(\alpha, R)$. The amount of slide of the slider and the oscillation rotational angle of the output shaft have thus no linear relationship with each other. According to the present invention, therefore, the above-mentioned relationship between the input shaft and output shaft is stored as a program in the memory 108 whereby correction is effected for the purpose of control operation.

I claim:

1. A roll feed apparatus comprising:

a pair of rolls for holding a plate material therebetween and being oscillated thereby to feed the plate material intermittently by a predetermined length each time;

a material thickness adjusting mechanism for adjusting the distance between the two rolls;

a holding power adjusting mechanism for adjusting the power of the two rolls for holding the material;

a feed length adjusting mechanism for adjusting the predetermined length that is a length of feed of the plate material by the two rolls;

first drive means for driving the material thickness adjusting mechanism;

second drive means for driving the holding power adjusting mechanism;

third drive means for driving the feed length adjusting mechanism;

a first signal generator for generating a signal representing the operating conditions of the first drive means;

a second signal generator for generating a signal representing the operating conditions of the second drive means;

a third signal generator for generating a signal representing the operating conditions of the third drive means;

input means for entering numerical data providing adjustment targets of the material thickness, the holding power and the material feed length respectively;

processing means supplied with numerical data entered by the input means and signals from the material thickness adjusting mechanism, the holding power adjusting mechanism and the material feed length adjusting mechanism representing the ranges of operation thereof respectively, the processing means applying control commands to the drive means; and comparator means supplied with the control commands from the processing means and comparing the control commands with the input signals of the first, second and third signal generators respectively thereby to produce drive signals for the respective drive means.

2. A roll feed apparatus according to claim 1, wherein the first, second and third drive means are servo motors including the signal generators as encoders respectively.

3. A roll feed apparatus according to claim 1, wherein the processing means prepares a control command relating to the rotational angle and a control command relating to the rotational direction of the drive means providing an object to be controlled.

4. A roll feed apparatus according to claim 1, wherein the comparator means includes at least a pulse shaping direction discrimination circuit and an error counter, the pulse shaping direction discrimination circuit determining a target distance coverage to be controlled in accordance with the control commands supplied from the signal generators and the position data of the output shafts of the drive means, the error counter having the distance coverage set therein.

5. A roll feed apparatus according to claim 4, wherein the comparator means includes at least a D/A converter and an F/V converter, the D/A converter converting the digital value set in the error counter into a corresponding voltage, the F/V converter converting the frequencies of the pulse signals associated with the rotational speed of the output shafts of the drive means supplied from the signal generators into corresponding voltages, the roll feed apparatus further comprising means for supplying the difference between the output of the D/A converter and that of the F/V converter as a speed command signal to the drive means to be controlled.

* * * * *